United States Patent [19]

Klar

[11] 4,170,466

[45] Oct. 9, 1979

[54] WATER ATOMIZED COPPER ALLOYS

[75] Inventor: Erhard Klar, Beachwood, Ohio

[73] Assignee: SCM Corporation, New York, N.Y.

[21] Appl. No.: 950,381

[22] Filed: Oct. 11, 1978

[51] Int. Cl.[2] ..... B22D 23/08
[52] U.S. Cl. ..... 75/0.5 C; 264/11
[58] Field of Search ..... 75/0.5 C, 0.5 B; 264/11

[56] References Cited

U.S. PATENT DOCUMENTS

| | | | |
|---|---|---|---|
| 2,870,485 | 1/1959 | Jones | 264/11 |
| 3,765,866 | 10/1973 | Nayar | 75/0.5 B |

*Primary Examiner*—W. Stallard
*Attorney, Agent, or Firm*—Thomas M. Schmitz

[57] ABSTRACT

A water atomization process for producing fine metal particles includes the improvement step of alloying a minor amount of silicon with copper and a metal selected from manganese, chromium, and zirconium.

4 Claims, No Drawings

WATER ATOMIZED COPPER ALLOYS

BACKGROUND OF THE INVENTION

This invention pertains to water atomization of metals and more particularly to a method of producing atomized alloy particles containing substantially reduced amounts of metal oxides formed during the water atomizing process.

Water atomization of molten metal alloys is shown in U.S. Pat. No. 2,956,304 wherein metal particles are produced at a particularly small particle size less than 100 mesh. Water atomization of molten metals appears to cause considerable oxidation of certain copper alloy products due to the high temperatures of the molten metal and the oxidizing characteristics of the water itself. High levels of metal oxides increase corrosion as well as decrease compacting properties of metal powders in conventional powder metallurgy. Further, various metal alloys can create an explosion hazard during the water atomization process due to the high level of oxide formation in the alloy particles produced during the water atomization process. Oxidation apparently forms free hydrogen which then tends to form an explosive mixture with oxygen and/or surrounding air. Alloys having considerable affinity for oxygen include for example, copper-manganese, copper-chromium, and copper-zirconium alloys. As the level of oxidation increases, the greater is the chance of explosion. Oxidation depends on the metal melt temperatures and inclusion of preferentially oxidizable metals such as manganese, chromium, and/or zirconium.

It now has been found that the inclusion of minor amounts of silicon within the copper alloy to produce an alloy containing approximately a weight ratio of about 9/1 of oxidazable metal to silicon effectively eliminates the explosion hazard during the water atomization process and further produces an improved copper alloy having a substantially reduced oxide content. The silicon becomes preferentially oxidized rather than oxidazable alloy metal such as manganese, chromium, and zirconium. The minor amount of silicon is believed to diffuse to the surface of individual atomized particles during the water atomization process and to form a protective surface oxide film of the silicon dioxide whereby the alloy metal particles remain in a non-oxidized state. The oxide film appears to eliminate the explosion hazard and provides an improved alloy powder. Powders essentially free of oxides have improved compacting properties, reduce corrosion of the metal alloy particles, and impart superior brazing characteristics.

These and other advantages of this invention will become more apparent by referring to the Detailed Description of the Invention.

SUMMARY OF THE INVENTION

An improved water atomization process comprises the improvement step of including a minor amount of silicon into a copper alloy containing oxidizable metals selected from manganese, chromium, and zirconium to produce atomized alloy particles substantially free of oxidation. The water atomized copper alloy contains by weight at least about 0.1% silicon and generally a weight ratio of 9 parts oxidizable metal to 1 part silicon.

DETAILED DESCRIPTION OF THE INVENTION

Copper alloys which can be water atomized according to this invention are copper alloys containing relative noble copper alloyed with higher oxidizing metals having a high negative free energy of formation. The oxidizable metals have a negative free energy of oxide formation at 25° C. of at least about 80 kilocalories per gram atom of oxygen and can be selected from manganese, chromium, and zirconium metals. The copper alloy contains by weight over 50% copper alloyed with at least 1% of oxidizable metal. Thus, a copper-zirconium alloy could contain 1% zirconium at about 0.1% silicon with the balance being copper.

A particularly desirable copper-manganese alloy, for example, alloy contains between about 25% and 50%, and preferably 30% to 40%, by weight manganese. This copper-manganese alloy can be safely produced by water atomization in accordance with the process of this invention by the inclusion of at least about 0.2%, and preferably between about 0.5% and 4% by weight silicon. The use of minor amounts of silicon substantially reduces oxidation of the copper alloy material during water atomization wherein the highly oxidizable silicon appears to migrate to the particle surface and preferentially cause an oxide film to form on the surface rather than throughout the alloy particle. For formation of a silicon dioxide film appears to eliminate the hazardous formation of hydrogen believed to occur during substantial oxidation of the copper alloy in prior art processes. The elimination of free hydrogen in turns avoids the explosive mixture of hydrogen and oxygen.

The advantages of this invention will be further illustrated in the following examples:

EXAMPLE 1

Copper-manganese alloys were atomized by the water atomization according to the process described in U.S. Pat. No. 2,956,304 to produce alloys with the following compositions:

| Composition | Sample A. | Sample B. | Sample C. |
|---|---|---|---|
| Manganese | 33.0% | 32.1% | 40.0% |
| Silicon | 1.46% | 2.14% | — |
| Oxygen | 0.19% | 0.49% | 1.13% |
| Copper | Balance | Balance | Balance |
| Screen Analysis: | | | |
| −100 + 140 | 17.40% | 22.06% | 8.22% |
| −140 + 200 | 18.63% | 19.98% | 16.83% |
| −200 + 270 | 22.30% | 20.03% | 23.90% |
| −270 + 325 | 3.72% | 4.85% | 6.50% |
| −325 | 37.95% | 32.58% | 44.54% |
| (g/cc) | | | |
| Apparent Density | 2.04% | 1.81% | 2.30% |

These alloys have a melting point between 1650–1700° F. At oxygen levels below about 0.50% or 5000 ppm the explosion hazard is essentially eliminated. Example C created a substantial explosion hazard.

The foregoing examples are illustrative only and are not intended to be limiting except by the apended claims.

I claim:

1. An explosion-free water atomization process for atomization of molten copper alloys to produce fine particle size copper alloy powders, the improvement comprising:

providing a copper alloy consisting of by weight at least 50% copper alloyed with at least 0.1% silicon and an oxidizable metal selected from manganese, chromium, or zirconium, said silicon level being between about 0.1% and 4%; and water atomizing said alloy to provide copper alloy particles substantially free of oxides and with a surface silicon dioxide film.

2. The process in claim 1 wherein said copper alloy is a copper-manganese alloy containing between about 30% to 40% manganese and 0.5% and 3% silicon.

3. The process in claim 1 wherein the copper alloy is a copper-chromium alloy containing between about 1% and 2% chromium and between about 0.1% and 0.2% silicon.

4. The process in claim 3 wherein the copper alloy contains between about 1% and 2% zirconium and 0.1% and 0.2% zirconium.

* * * * *